United States Patent [19]

Nishizawa

[11] Patent Number: 4,877,004

[45] Date of Patent: Oct. 31, 1989

[54] INTERNAL COMBUSTION ENGINE FOR A VEHICLE

[75] Inventor: Hiroyuki Nishizawa, Kyoto, Japan

[73] Assignee: Mitsubishi Jidosha Kogyo Kabushiki Kaisha, Tokyo, Japan

[21] Appl. No.: 283,227

[22] Filed: Dec. 12, 1988

[30] Foreign Application Priority Data

Dec. 18, 1987 [JP] Japan ..... 62-192081[U]

[51] Int. Cl.[4] ..... F02B 15/00

[52] U.S. Cl. ..... 123/432; 123/308; 123/188 M

[58] Field of Search ..... 123/432, 108 M, 308, 123/472

[56] References Cited

U.S. PATENT DOCUMENTS

| | | | |
|---|---|---|---|
| 4,519,370 | 5/1985 | Iwata | 123/432 |
| 4,617,896 | 10/1986 | Yoshikawa | 123/432 |
| 4,651,696 | 3/1987 | Yoshikawa et al. | 123/432 |
| 4,726,341 | 2/1988 | Muranaka et al. | 123/432 |

FOREIGN PATENT DOCUMENTS 61-186726 11/1986 Japan .

*Primary Examiner*—E. Rollins Cross

*Attorney, Agent, or Firm*—Frishauf, Holtz, Goodman & Woodward

[57] ABSTRACT

An internal combustion engine for a vehicle comprising three intake ports for each combustion chamber, three intake valves for opening and closing the intake ports, and an intake passage connected to the combustion chamber through the three intake ports, the lower-course region of the intake passage on the intake-port side being divided into three separate branch intake passages leading to the individual intake ports. The internal combustion engine according to the present invention further comprises a fuel injection valve disposed on the upper-course side of the branch intake passages of the intake passage, the injection valve having three jets through which atomized fuel flows of substantially equal quantities are injected toward their corresponding branch intake passages.

9 Claims, 6 Drawing Sheets

INTERNAL COMBUSTION ENGINE FOR A VEHICLE

BACKGROUND OF THE INVENTION

The present invention relates to an internal combustion engine for a vehicle, and more particularly, to an internal combustion engine improved in the charging efficiency of an air-fuel mixture to each cylinder of the engine.

In a conventional four-cycle internal combustion engine for an automobile comprises one intake valve and one exhaust valve for each cylinder or combustion chamber. In order to enhance the output performance of the engine of this type, the charging efficiency of an air-fuel mixture to the combustion chambers and the discharging efficiency of exhaust gases therefrom must be improved. To attain this, an intake port and an exhaust port of each combustion chamber, adapted to be opened and closed by means of the intake valve and the exhaust valve, in each engine cylinder, should preferably be maximized in size. Usually, however, the intake and exhaust ports, as well as the bore of the cylinder, are circular in shape, so that their maximum permissible size is restricted by the diameter of the cylinder bore. Accordingly, there are some conventional engines in which the number of intake and exhaust ports for each cylinder is increased in order that the total opening areas of the ports are large enough even though the opening area of each port is reduced.

One such conventional engine comprises, for example, two intake ports and two exhaust ports for each cylinder and twin camshafts. The engine of this type, having two intake valves and two exhaust valves for opening and closing the intake and exhaust ports, respectively, are called a four-valve engine.

As compared with the two-valve engine, having one intake valve and one exhaust valve for each cylinder, the four-valve engine can enjoy improved output performance, higher rotating speed due to reduction of the weight of valve drive mechanisms, and less mechanical loss. Also, the low- and medium-speed torque performance can be improved by controlling the valve timing. Thus, the four-valve engine has started to be used as a practical engine, as well as a high-output engine for a sports car or the like.

There has recently been a demand for an engine whose output can be made higher than the four-valve engine, and in which the amount of fuel supply to the combustion chambers can be controlled in accordance with the operating conditions of the engine.

In developing the engine of this type, the engine output may be further improved by increasing the number of intake valves used in the engine to five. In this case, the developed engine is a five-valve engine. In order to control the fuel supply to the combustion chambers in accordance with the operating conditions of the engine, moreover, the operation of fuel injection valves, which are used to inject fuel directly into an intake manifold connecting with the individual combustion chambers, may be controlled by means of an electronic control device. The electronic control device, which includes a programmable electronic circuit such as a microcomputer, serves to determine the operating conditions of the engine in accordance with signals from various sensors, and control the operation of the fuel injection valve so that the air-fuel mixture can enjoy an optimum air-fuel ratio depending on the operating conditions.

In a specific example of the aforementioned internal combustion engine, the lower-course region of the inside of an intake passage leading to each cylinder is divided into three branch intake passages, which are connected individually to intake ports adapted to cooperate with their corresponding intake valves, and one fuel injection valve is disposed in a region on the upper-course side of the branch intake passages of each intake passage.

FIGS. 1 and 2 show a conventional one-flow injection valve 10 which has one jet 10*a*, and is used in the internal combustion engine of the aforesaid type. In the injection valve 10, an atomized fuel flow 11 injected from the jet 10*a* is supplied to three intake ports, including a central intake port 13 and two outside intake ports 12 and 14.

FIGS. 3 and 4 show a conventional two-flow injection valve 15 which has two jets 15*a* and 15*b*. In the injection valve 15, two atomized fuel flows 16 and 17 are injected from jets 15*a* and 15*b*, respectively. The one fuel flow 16 is supplied to the one outside intake port and one half of the central intake port 13, while the other fuel flow 17 is supplied to the other outside intake port 14 and the other half of the central intake port 13.

In the engine having the fuel injection valves of this type, however, fuel injected from each fuel injection valve has the form of one or two atomized fuel flows which radially spread toward the branch intake passages. It is difficult, therefore, to distribute the atomized fuel flow or flows uniformly to the three branch intake passages. Thus, air-fuel mixtures fed individually through the intake ports into each combustion chamber are different in fuel concentration. In consequence, the fuel concentration distribution in the combustion chambers is uneven, so that the fuel cannot undergo perfect combustion.

FIGS. 5 to 7 show a free-flow injection valve 18, disclosed in Japanese Utility Model Disclosure No. 61-186726, which has three jets 18*a*, 18*b* and 18*c*. The jets 18*a*, 18*b* and 18*c* of the injection valve 18, which serve to inject fuel toward intake ports 12, 13 and 14, respectively, are arranged in a straight line, and open so that the central jet 18*b* enjoys the largest injection quantity. Having different opening areas, the jets 18*a* to 18*c* are intended positively to cause unevenness in the fuel concentration distribution. In the engine disclosed in Japanese Utility Model Disclosure No. 61-186726, an intake control valve (not shown) is disposed in the intake port 12. The control valve is opened and closed during high- and low-load operations of the engine, respectively, so that the low-load combustion performance is improved. When the intake control valve is closed, however, a greater amount of fuel adheres to the wall surface near the intake port in which the control valve is located, so that the air-fuel ratio of the air-fuel mixture introduced through the central intake port 13 is excessively fuel-rich. Also when the intake control valve is open, only the air-fuel mixture from the central intake port 13 is excessively fuel-rich.

The fuel supplied to the combustion chambers is also utilized for cooling the intake valves. If the atomized fuel flows passing through the individual branch intake passages are different in fuel concentration, however, the intake valves cannot be cooled uniformly.

As mentioned before, moreover, the atomized fuel flows from each fuel injection valve radially spread toward the branch intake passages, so that the amount of fuel adhering to the respective inner walls of the branch passages naturally increases. Accordingly, the necessary fuel amount cannot be secured for acceleration. If the fuel supply is interrupted at the time of deceleration, on the other hand, the fuel adhering to the wall surface flows into the combustion chambers, thus exerting a bad influence on the responsiveness of the engine.

OBJECT AND SUMMARY OF THE INVENTION

The object of the present invention is to provide an internal combustion engine for a vehicle, which has three intake valves, i.e., three intake ports, for each cylinder so that air-fuel mixtures of uniform fuel concentration can be fed into a combustion chamber through the individual intake ports, thus ensuring improvement in the fuel combustion efficiency, the cooling efficiency of the intake valves, and the responsiveness of the engine.

The above object of the present invention is achieved by an internal combustion engine for a vehicle, which comprises port means defining three intake ports opening into a combustion chamber; an intake valve unit for opening and closing the three intake ports; passage means defining an intake passage connected to the combustion chamber through the three intake ports; partition wall means for dividing the lower-course region of the intake passage on the intake-port side into three separate branch intake passages leading to the individual intake ports; and a fuel injection valve disposed on the upper-course side of the branch intake passages of the intake passage and adapted to inject a fuel into the intake passage, the fuel injection valve including an injection end face fronting the inside of the intake passage and three jets through which atomized fuel flows of substantially equal quantities are injected toward the branch intake passages corresponding thereto, the jets being formed in the injection end face.

According to the internal combustion engine described above, the fuel injection valve is provided with the three jets, and the atomized fuel flows of equal quantities are independently injected through the jets toward their corresponding intake ports. Therefore, the amounts of fuel introduced through the individual intake ports into the combustion chamber are also equal. Thus, the distribution of the fuel fed into the combustion chamber is even, so that the combustion efficiency is improved, the output and torque of the engine can be increased, and production of soot in exhaust gas can be prevented. Since the fuel distribution in the combustion chamber can be made uniform, the start of the engine, especially at low temperature, can be facilitated, and a stable operating state can be obtained. Further, the amounts of fuel used to cool intake valves for opening and closing the individual intake ports are also equal, so that the intake valves can enjoy the same cooling effect.

Since the fuel injection valve produces the independent atomized fuel flows bound for the individual intake ports, the amount of fuel adhering to the intake passage, especially the inner walls of the branch intake passages, can be effectively restricted. Thus, the responsiveness of the engine can be improved.

According to the present invention, furthermore, the intake ports are three in number, so that each intake valve for opening and closing each corresponding intake port, in the intake valve unit, can be reduced in size, and hence, in weight. In consequence, the load acting on drive mechanisms for the intake valves can be reduced, so that the engine speed can be increased, and the valve timing for each intake valve can be controlled with high accuracy.

The above and other objects, features, and advantages of the invention will be more apparent from the ensuing detailed description taken in connection with the accompanying drawings.

DETAILED DESCRIPTION

Figure 1:
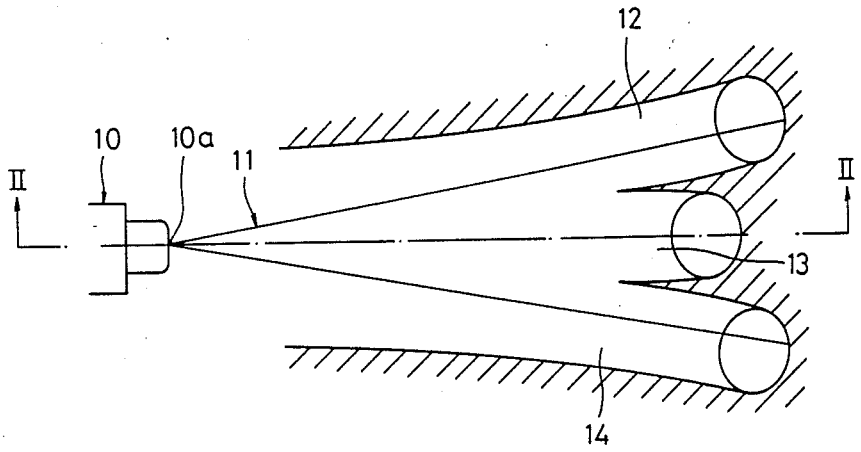
FIG. 1 (PRIOR ART)
FIG. 1 is a horizontal sectional view showing part of an intake pipe leading to one cylinder of a prior art internal combustion engine and a fuel injection valve of a one-flow type.
Figure 2:
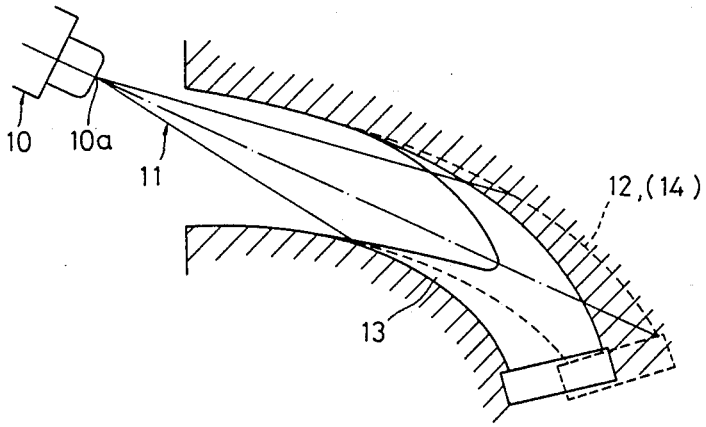
FIG. 2 (PRIOR ART)
FIG. 2 is a vertical sectional view taken along line II—II of FIG. 1.
Figure 3:
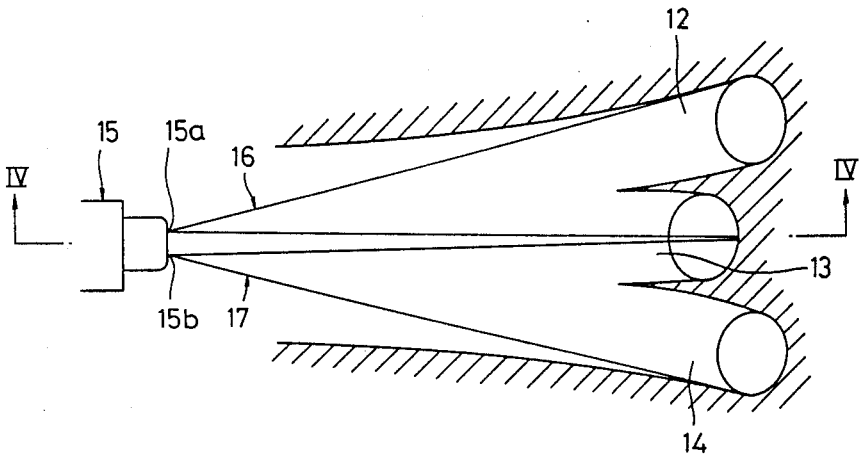
FIG. 3 (PRIOR ART)
FIG. 3 is a horizontal sectional view showing part of an intake pipe leading to one cylinder of another prior art internal combustion engine and a fuel injection valve of a two-flow type.
Figure 4:
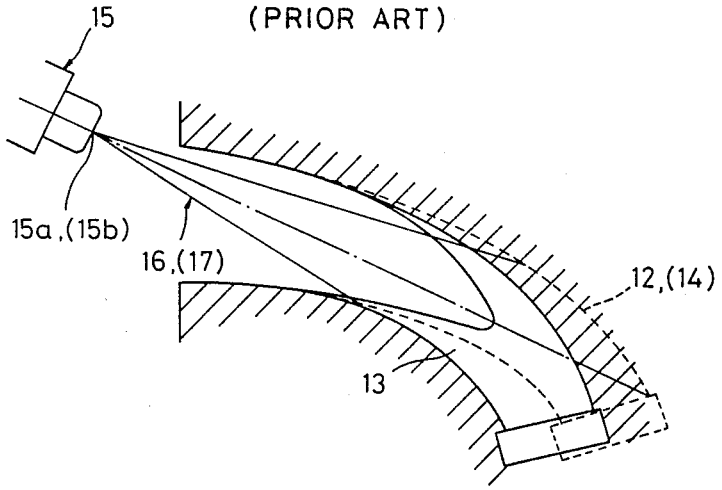
FIG. 4 (PRIOR ART)
FIG. 4 is a vertical sectional view taken along line IV—IV of FIG. 3.
Figure 5:
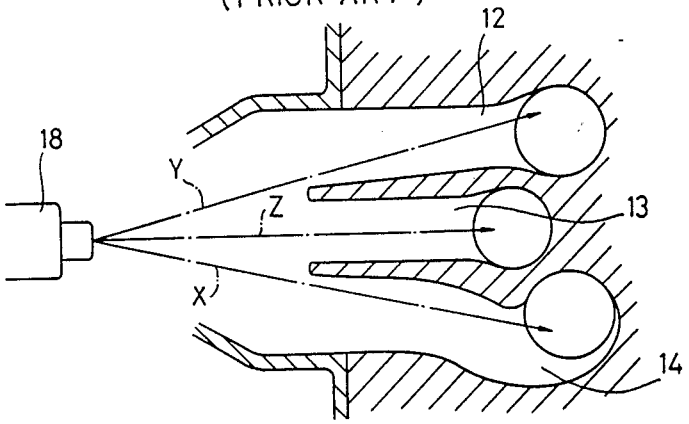
FIG. 5 (PRIOR ART)
FIG. 5 is a horizontal sectional view showing part of an intake pipe leading to one cylinder of still another prior art internal combustion engine and a fuel injection valve of a three-flow type.
Figure 6:
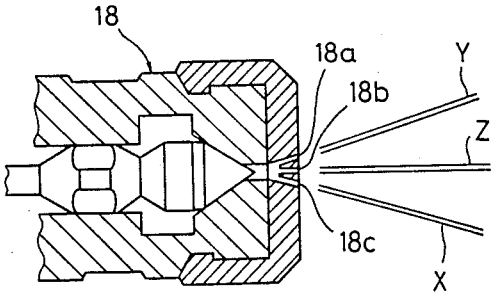
FIG. 6 (PRIOR ART)
FIG. 6 is an enlarged sectional view of the three-flow injection valve shown in FIG. 5.
Figure 7:
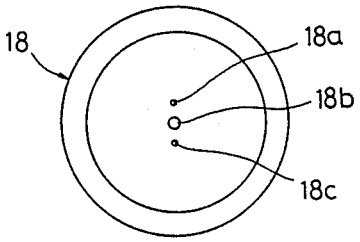
FIG. 7 (PRIOR ART)
FIG. 7 is a front view showing jets of the three-flow injection valve shown in FIG. 5.
Figure 8:
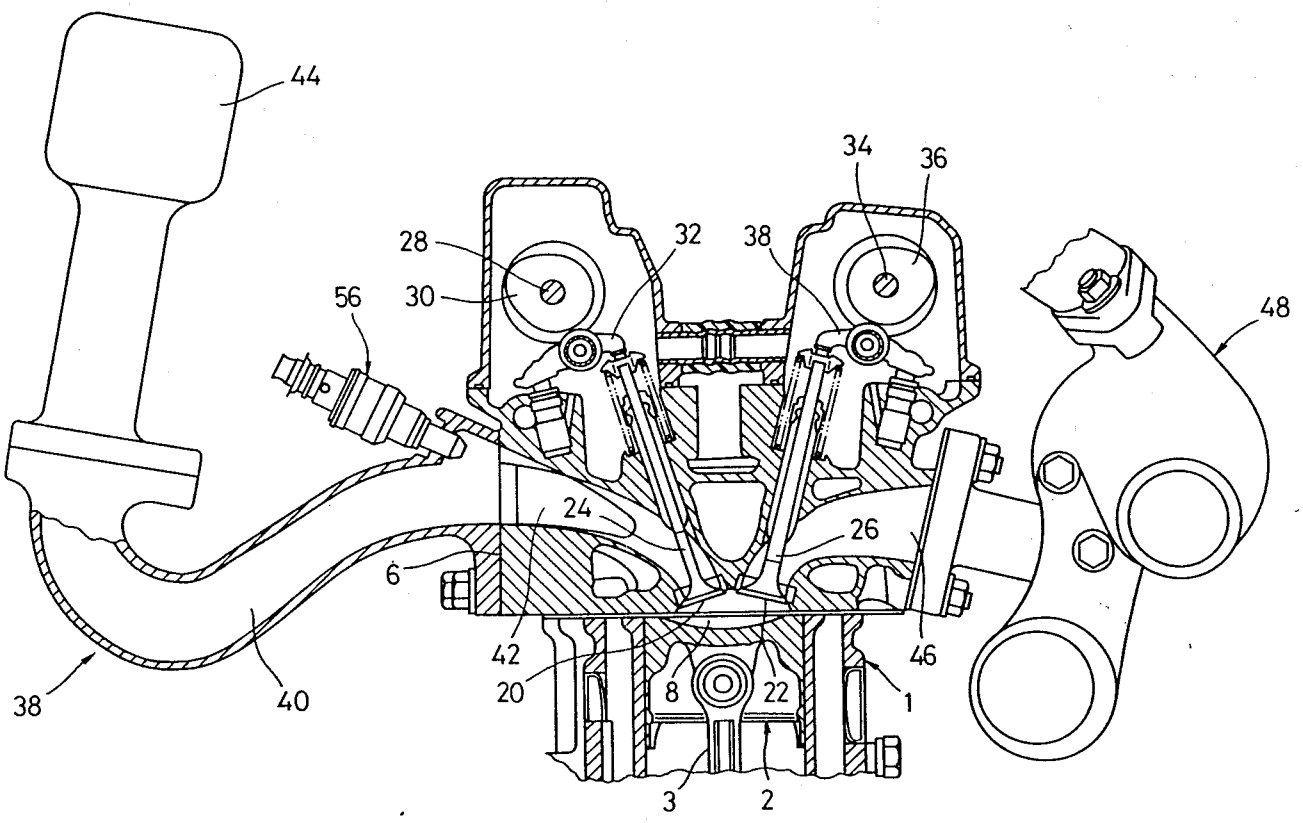
FIG. 8 is a sectional view schematically showing part of an internal combustion engine for a vehicle according to an embodiment of the present invention.

Referring now to FIG. 8, there is schematically shown a section of the top portion of an internal combustion engine for a vehicle. This engine has a cylinder block 1 in which are defined cylinder bores as many as cylinders of the engine. A piston 2 is fitted in each cylinder bore, and is connected to a crankshaft (not shown) by means of a connecting rod 3. In FIG. 8, a cylinder head 6 is disposed on the top of the cylinder block 1, and a combustion chamber 8 is defined between the cylinder head 6 and the piston 2, inside each cylinder bore.

The cylinder head 6 has three intake ports 20 of the same diameter and two exhaust ports 22 for each combustion chamber 8. These ports 20 and 22 open individually into the combustion chamber 8. FIG. 8 shows only each one of the intake ports and the exhaust ports for simplicity of illustration. Each intake port 20 is adapted to be opened and closed by means of an intake valve 24 which is formed of a poppet valve. Like the intake port 20, each exhaust port 22 is adapted to be opened and closed by means of an exhaust valve 26 formed of a poppet valve. As seen from Fig. 8, the intake valve 24 and the exhaust valve 26 are operated by means of a double overhead camshaft system. Thus, a single camshaft 28 is provided for the intake valve 24. As the camshaft 28 rotates, a cam 30 on the camshaft 28 and a rocker arm 32 cooperate with each other to actuate each corresponding intake valve 24. Another camshaft 34 is provided for the exhaust valve 26. As the camshaft 34 rotates, as in the case of the intake valve 24, a cam 36 and a rocker arm 38 cooperate with each other to actuate each corresponding exhaust valve 26. It is to be noted that the three intake valves 24 for each combustion chamber 8 are operated in synchronism with one another, and the two exhaust valves 26 for each chamber 8 are also operated synchronously with each other.

The three intake ports 20 for each combustion chamber 8 are connected to one intake pipe 40 of an intake manifold 38 through an internal passage 42 defined inside the cylinder head 6. Thus, the intake pipe 40 and the internal passage 42 constitute part of an intake passage through which an air-fuel mixture is introduced into the combustion chamber 8. The intake manifold 38 is connected to an air cleaner (not shown) through a surge tank 44. Meanwhile, the two exhaust ports 22 of each combustion chamber 8 are connected to an exhaust passage 46. The engine of FIG. 8 is provided with a turbocharger 48 which is driven by means of exhaust gas flowing through the exhaust passage 46. The turbocharger 48 has a function to pressurize air supplied to the intake manifold 38. An ignition plug is not shown in FIG. 8.

The internal passages 42, which communicate individually with the combustion chambers 8, have the same construction, so that only one of them will be described below.

Figure 9:
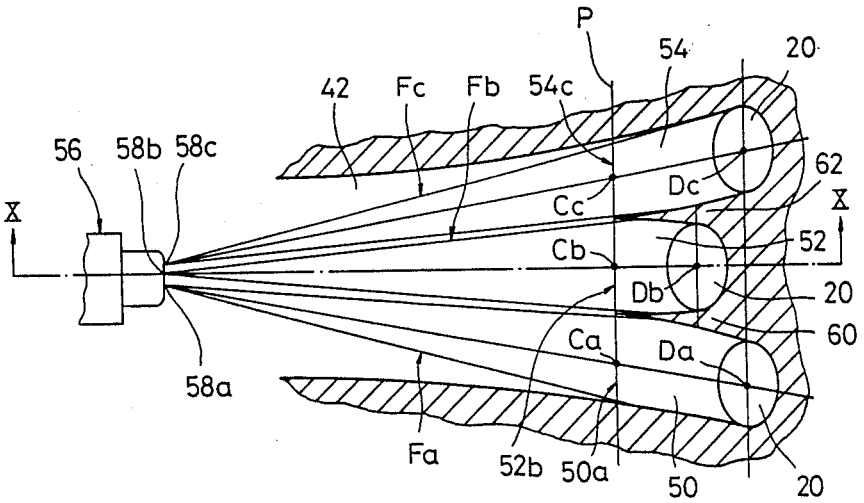
FIG. 9 is a horizontal sectional view showing part of an intake pipe leading to one cylinder of the engine of FIG. 8 and a fuel injection valve.

As shown in FIG. 9, the internal passage 42, which constitutes part of the intake passage, includes three independent branch intake passages 50, 52 and 54 at its lower-course region on the side of the three intake ports 20. The passages 50, 52 and 54 are connected to their corresponding intake ports 20. These branch intake passages are substantially circular in cross-sectional shape, and have substantially the same cross-sectional area.

Figure 10:
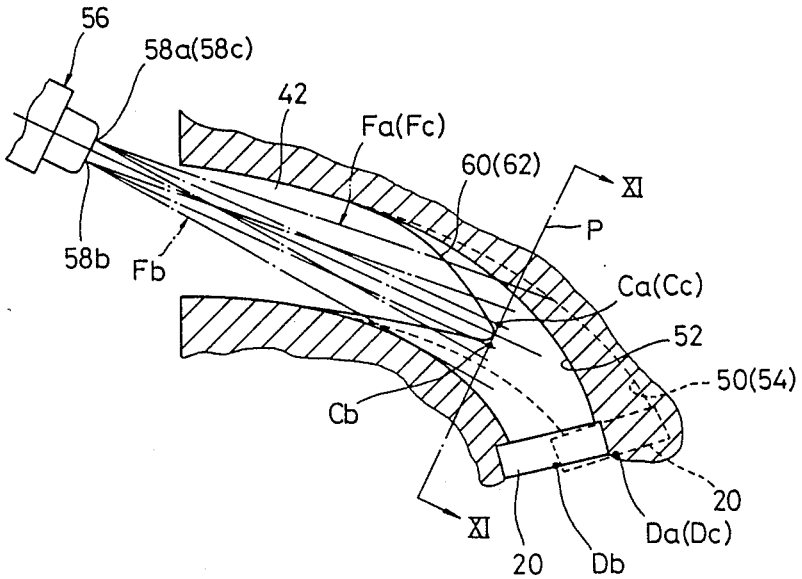
FIG. 10 is a vertical sectional view taken along line X—X of FIG. 9.

In this embodiment, as seen from FIGS. 9 and 10, the central branch intake passage 52, among the three branch passages 50, 52 and 54, is bent toward the piston 2 with a higher degree of curvature than the outside branch passages 50 and 54, and is then led to its corresponding intake port 20. Thus, among the three associated intake ports 20, the central intake port 20 (as in FIG. 9) which is connected to the branch intake passage 52 is situated closer to the piston 2 than the two others are. Also, the two other intake ports 20 are positioned at equal distances from the piston 2. In other words, the center of the central intake port 20 is situated within a plane which contains the center line of the internal passage 42 and extends along the axis of the piston 12, while the respective centers of the two other intake ports 20 are positioned at equal distances from that plane. The intake valves 24 are not shown in FIGS. 9 and 10.

Referring again to FIG. 8, the intake pipe 40, which constitutes part of each intake passage, is provided with one fuel injection valve 56. The valve 56 is attached to that region of the intake pipe 40 which is situated close to the internal passage 42 so that the front end of the valve 56 faces the passage 42. More specifically, the fuel injection valve 56 is disposed so that its axis is situated within the aforesaid plane and extends along the internal passage 42. The valve 56 is connected to a fuel pump (not shown), and the injection quantity of fuel injected from the valve 56 is controlled by means of an electronic control device (not shown) which includes a microcomputer.

Figure 12:
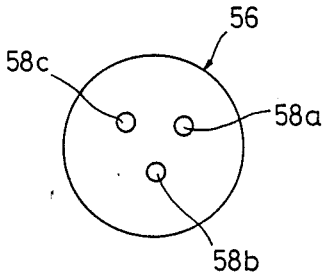
FIG. 12 is a front view showing jets of the injection valve shown in FIG. 9.

As shown in FIG. 12, the fuel injection valve 56 has three jets 58*a*, 58*b* and 58*c* in its front end face which projects into the intake pipe 40. Among these jets, the jets 58*a* and 58*c* are deviated upward (as in FIGS. 10 and 12) from the center of the front end face of the fuel injection valve 56, when the valve 56 is in the aforementioned mounted position, and are arranged on the circumference of the same circle. On the other hand, the remaining jet 58*b* is situated below and between the jets 58*a* and 58*c*, as shown in FIGS. 10 and 12. Thus, the three jets 58*a*, 58*b* and 58*c* are situated individually corresponding to the three vertexes of an isosceles triangle whose base corresponds to a segment connecting the jets 58*a* and 58*c*. The jets 58*a*, 58*b* and 58*c* are associated with the branch intake passages 50, 52 and 54, respectively. Accordingly, the jet 58*b* is allocated to the central intake port 20, while the jets 58*a* and 58*c* are allocated individually to the two outside intake ports 20. The jets 58*a*, 58*b* and 58*c* have substantially the same diameter, so that substantially the same quantity of fuel is injected from each jet when the fuel is injected from the fuel injection valve 56. The arrangement of the jets is not limited to the aforesaid configuration, and all the three jets may be arranged on the circumference of the same circle.

When the fuel is injected from the fuel injection valve 56, it flows in the form of three atomized fuel flows Fa, Fb and Fc from the jets 58*a*, 58*b* and 58*c* toward their corresponding intake ports 20. Preferably, the respective axes of the fuel flows Fa, Fb and Fc are located so as to pass diverging inlets 50*a*, 52*b* and 54*c* of their corresponding branch intake passages 50, 52 and 54, more specifically, centers Ca, Cb and Cc of the inlets, the inlets being situated within a plane P which is perpendicular to the axis of the fuel injection valve 56. The plane P contains the respective tip ends of two partition walls 60 and 62 which define the three branch intake passages. Hereinafter, the plane P will be referred to as a formation plane for the branch intake passages.

Figure 11:
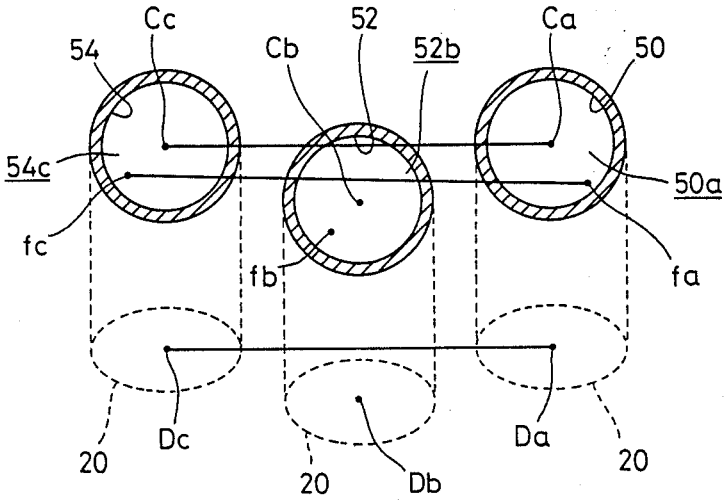
FIG. 11 is a sectional view taken along line XI—XI of FIG. 10.

In this embodiment, the diverging inlets 50*a* and 54*c*, among the three inlets on the formation plane P, are situated on the same level with one another, with respect to the combustion chamber 8 which is located on the lower side of FIG. 11. On the other hand, the diverging inlet 52*b* is situated on a level below that of the inlets 50*a* and 54*c*.

As described above, the best situation can be established if the axes of the atomized fuel flows Fa, Fb and Fc from the fuel injection valve 56 pass the centers Ca, Cb and Cc of the diverging inlets 50*a*, 52*b* and 54*c*, respectively. Practically, however, it is difficult to effect such an arrangement, so that the axes of the fuel flows Fa, Fb and Fc are located so as to pass regions near the centers Ca, Cb and Cc of their corresponding inlets 50*a*, 52*b* and 54*c*.

As mentioned before, the central branch intake passage 52, among the three branch passages, is bent toward the piston 2 with a higher degree of curvature than the outside branch passages 50 and 54, as shown in FIG. 10. Accordingly, the atomized fuel flow Fb in the branch intake passage 52 strikes against the inner wall of the passage 52 at a higher rate than the atomized fuel flows Fa and Fc in the other branch intake passages 50 and 54. Thus, a greater amount of fuel adheres to the inner wall of the passage 52 than to those of the passages 50 and 54. In order to avoid such an awkward situation, the target point at which the axis of the jet 58*b* of the fuel injection valve 56, i.e., the axis of the atomized fuel flow Fb, crosses the diverging inlet 52*b* of the branch intake passage 52 is preferably set as follows.

Now let it be assumed that the points at which the respective axes of the atomized fuel flows Fa, Fb and Fc from the fuel injection valve 56 actually cross the diverging inlets 50*a*, 52*b* and 54*c* of their corresponding branch intake passages 50, 52 and 54, within the formation plane P, are fa, fb and fc, respectively, and that the center points of the three intake ports 20 are Da, Db and Dc, respectively, as shown in FIG. 11. Thereupon, the axis of the atomized fuel flow Fb is inclined so as to extend on the side of the center point Db, with respect to a segment of line connecting the center points Da and Dc and extending parallel to the formation plane P, as shown in FIG. 9. Also, the point fb at which the axis of the atomized fuel flow Fb crosses the diverging inlet 52*b* of the branch intake passage 52 is situated on the side of the center point Db or on the side of the piston 2, with respect to a segment connecting the points fa and fc, as shown in FIG. 11.

More specifically, the atomized fuel flow Fb and the point fb are directed or positioned so that the axis of the flow Fb passes a point on the side of the inside portion (with respect to the curvature) of the wall surface of the branch intake passage 52, with respect to the center Cb of the diverging inlet 52*b*. As shown in FIG. 10, moreover, the curvature of the two other branch intake passages 50 and 54 is gentler than that of the passage 52. Since these three branch intake passages are bent in the same direction, however, the axes of the atomized fuel flows Fa and Fc are preferably arranged so as to pass the points fa and fc, respectively, on the side of the piston 2, with respect to the respective centers Ca and Cc of the diverging inlets 50*a* and 54*c*, as shown in FIG. 11. If the branch intake passages 50 and 54 are bent outward (as in FIG. 9) from the branch intake passage 52 and toward the segment connecting the centers Da and Dc, the points fa and fc at which the atomized fuel flows Fa and Fc cross the diverging inlets 50*a* and 54*c*, respectively, are preferably shifted outward with respect the passage 52, as shown in FIG. 11.

As seen from FIG. 9, moreover, the three atomized fuel flows Fa, Fb and Fc from the fuel injection valve 56 are radially spread toward the branch intake passages 50, 52 and 54. In this arrangement, all the regions at which the atomized fuel flows Fa, Fb and Fc cross the diverging inlets 50*a*, 52*b*, and 54*c*, respectively, are contained in their corresponding diverging inlets. Therefore, each atomized fuel flow can never enter the branch intake passage adjacent to its corresponding one.

In the engine described above, the fuel injection valve 56 is opened at predetermined time intervals and for a predetermined period of time to effect injection of an optimum quantity of fuel, in accordance with the operating conditions of the engine determined by means of the electronic control device. When the fuel injection valve 56 is opened, the three atomized fuel flows Fa, Fb and Fc of substantially equal quantities are simultaneously injected from the jets 58*a*, 58*b* and 58*c*, respectively. The fuel flows Fa, Fb and Fc pass through their corresponding branch intake passages 50, 52 and 54 while spreading radially. Thus, these fuel flows enter the combustion chamber 8 after passing through their corresponding intake ports 20 only.

What is claimed is:

1. An internal combustion engine for a vehicle which has at least one combustion chamber, said engine comprising:

port means defining three intake ports opening into said combustion chamber;

an intake valve unit for opening and closing said three intake ports;

passage means defining an intake passage connected to said combustion chamber through said three intake ports;

partition wall means for dividing the lower-course region of said intake passage on the intake-port side into three separate branch intake passages leading to said individual intake ports; and a fuel injection valve disposed on the upper course side of said branch intake passages of said intake passage and adapted to inject a fuel into said intake passage, said fuel injection valve including an injection end face fronting the inside of said intake passage and three jets through which atomized fuel flows of substantially equal quantities are injected toward said branch intake passages corresponding thereto, said jets being formed in said injection end face.

2. The internal combustion engine according to claim 1, wherein said partition wall means includes a pair of partition walls extending downstream from the middle portion of said intake passage toward said intake ports, and the respective axes of said three atomized fuel flows pass diverging inlets of said branch intake passages corresponding thereto, said diverging inlets being defined as opening regions of said individual branch intake passages contained in a formation plane, said formation plane being one of those planes which, individually containing the upper course regions of said partition walls, extend at right angles to the axis of said fuel injection valve, and on which said three branch intake passages are fully separated from one another, said formation plane being situated on the uppermost-course side of said other planes.

3. The internal combustion engine according to claim 2, wherein all the cross-sectional regions of said atomized fuel flows on said formation plane are included in said opening regions of said diverging inlets when said individual fuel flows pass said diverging inlets corresponding thereto.

4. The internal combustion engine according to claim 3, wherein the respective axes of said atomized fuel flows bound for said intake ports individually pass regions near the respective centers of said diverging inlets corresponding thereto.

5. The internal combustion engine according to claim 2, wherein said three intake ports are arranged side by side along said formation plane, the central one among said intake ports being one-sidedly situated on one side of a segment connecting the respective centers of the remaining two outside intake ports, nearer to said formation plane, or on the other side remoter from said formation plane, and that point at which the axis of said atomized fuel flow bound for said central intake port passes said diverging inlet associated therewith is located on the side corresponding to said central intake port, with respect to a segment between those points at which the respective axes of said other atomized fuel flows pass said diverging inlets associated therewith.

6. The internal combustion engine according to claim 5, wherein said central intake port is deflected toward said formation plane so that said branch intake passage leading to said central intake port is bent toward said combustion chamber with a higher degree of curvature than said two other branch intake passages.

7. The internal combustion engine according to claim 6, wherein the respective centers of said diverging inlets associated with said two outside intake ports are situated substantially on the same level with respect to said combustion chamber, and the center of said diverging inlet associated with said central intake port is situated on a level below said level.

8. The internal combustion engine according to claim 7, wherein the respective axes of said atomized fuel flows bound for said two outside intake ports individually pass regions near the respective centers of said diverging inlets corresponding thereto.

9. The internal combustion engine according to claim 1, wherein said three jets have substantially the same size.

* * * * *